US006324864B1

(12) United States Patent
Stewart et al.

(10) Patent No.: US 6,324,864 B1
(45) Date of Patent: Dec. 4, 2001

(54) CHILLER ARRANGEMENT FOR DRINK RECEPTACLES

(76) Inventors: Thomas Stewart; Diana Stewart, both of 876 Wyndom Ter., Secane, PA (US) 19018

( * ) Notice: Subject to any disclaimer, the term of this patent is extended or adjusted under 35 U.S.C. 154(b) by 0 days.

(21) Appl. No.: 09/537,925

(22) Filed: Mar. 29, 2000

(51) Int. Cl.[7] ..... F25D 3/08
(52) U.S. Cl. ..... 62/457.3; 62/530
(58) Field of Search ..... 62/530, 457.3, 62/527

(56) References Cited

U.S. PATENT DOCUMENTS

| | | | | |
|---|---|---|---|---|
| 2,591,375 | * | 4/1952 | Radford | 62/457.3 |
| 4,531,383 | | 7/1985 | Zimmermann | 62/457 |
| 5,044,173 | * | 9/1991 | Cheng | 62/372 |
| 5,129,238 | * | 7/1992 | Schwartz et al. | 62/457.3 |
| 5,189,892 | | 3/1993 | Roberts | 62/372 |
| 5,235,823 | | 8/1993 | Coker | 62/530 |
| 5,299,433 | * | 4/1994 | Harms et al. | 62/457.2 |
| 5,502,981 | | 4/1996 | Sullivan | 62/372 |
| 5,732,567 | | 3/1998 | Anderson | 62/457.4 |
| 5,799,501 | * | 9/1998 | Leonard et al. | 62/457.3 |

* cited by examiner

*Primary Examiner*—Henry Bennett
*Assistant Examiner*—Melvin Jones
(74) *Attorney, Agent, or Firm*—Henderson & Sturm LLP

(57) ABSTRACT

A chiller arrangement (10) for liquid beverages including a pitcher shaped serving receptacle member (20) having a receptacle base (22) provided with an internally threaded collar (27) adapted to engage the closed lower end (31) of a tubular insert member (30) containing a freezable gel (38). The upper end (31) of the tubular insert member (30) is sealingly engaged by a closure element (35) and covered by a cap member (40) bearing an advertising panel member (50) which can be employed to both advertise and identify the brand name of the liquid beverage contained within the serving receptacle member (20).

20 Claims, 2 Drawing Sheets

CHILLER ARRANGEMENT FOR DRINK RECEPTACLES

BACKGROUND OF THE INVENTION

1. Field of the Invention

The present invention relates to the field of chiller devices for drink receptacles in general, and in particular to a chiller tube that threadedly engages both a receptacle and an advertising accessory.

2. Description of Related Art

As can be seen by reference to the following U.S. Pat. Nos. 4,531,383; 5,189,892; 5,235,823; 5,502,981; and 5,732,567, the prior art is replete with myriad and diverse chiller insert arrangements for beverage receptacles.

While all of the aforementioned prior art constructions are more than adequate for the basic purpose and function for which they have been specifically designed, they are uniformly deficient with respect to their failure to provide a simple, efficient, and practical dual function chiller insert arrangement which both captively engages a chiller insert in a beverage receptacle, but also serves as a means for advertising and/or identifying a particular brand of beverage in a unique and novel fashion.

In the past, chiller inserts have either been permanently or loosely associated with a beverage receptacle and as such they have provided only a fairly limited function.

As a consequence of the foregoing situation, there has existed a long-standing need for a new and improved type of chiller arrangement for drink receptacles that will not only provide a chilling function, but will also serve to advertise and/or identify a specific beverage being served in the receptacle, and the provision of such an arrangement is a stated objective of the present invention.

BRIEF SUMMARY OF THE INVENTION

Briefly stated, the chiller arrangement for drink receptacles that forms the basis of the present invention comprises in general, a receptacle unit, a chiller unit, and an advertising unit.

As will be explained in greater detail further on in the specification, the receptacle unit includes a pitcher shaped serving receptacle member which is adapted to threadedly engage one end of the chiller unit which includes an elongated tubular insert member provided with a closure element to captively engage a quantity of freezable gel within the interior of the tubular insert member.

In addition, the advertising unit includes a cap member adapted to cover both the upper end of the tubular insert member, as well as the closure element wherein the cap member is fixedly secured to an advertising panel member that serves a variety of functions.

The advertising panel member not only provides a gripping surface to engage the cap member with the tubular insert member, but also functions to engage and disengage the tubular insert member with the serving receptacle member for purposes of cleaning.

Furthermore, the advertising panel member will serve the function of advertising the content of the receptacle member to different patrons, as well as assisting servers in identifying the contents of a particular serving receptacle member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
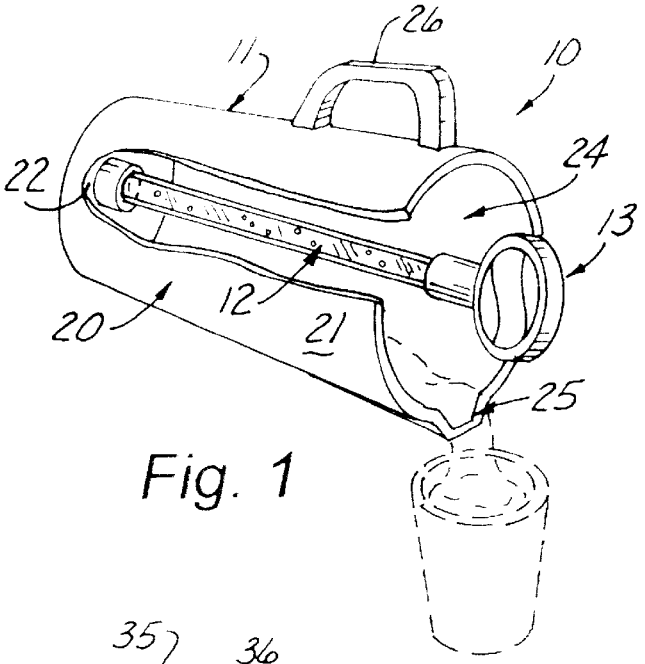
FIG. 1 is a partial cut away view of the chiller arrangement incorporated in the receptacle.

As can be seen by reference to the drawings, and in particular to FIG. 1, the chiller arrangement that forms the basis of the present invention is designated generally by the reference number 10. The arrangement 10 comprises in general, a receptacle unit 11, a chiller insert unit 12, and an advertising unit 13. These units will now be described in seriatim fashion.

Figure 4:
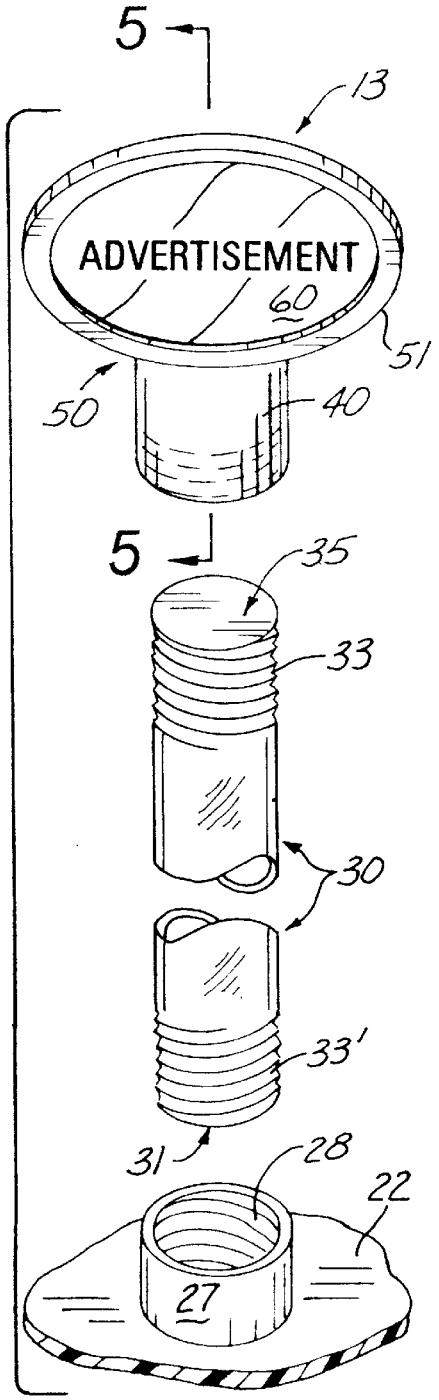
FIG. 4 is an exploded perspective view of a portion of the receptacle unit plus the chiller insert and advertising unit.

As shown in FIGS. 1 and 4, the receptacle unit 11 comprises a pitcher shaped serving receptacle member 20 having generally outwardly angled side walls 21 which project upwardly from a generally flat receptacle base 22. The upper end of the side walls 21 define an enlarged opening 24 provided with a pour spout 25.

In addition, the side walls 21 are further provided with a handle element 26 which is disposed on the opposite side of the receptacle member 20 and at a location positioned below the pour spout.

Furthermore, the interior surface of the receptacle base 22 is provided with a centrally disposed generally cylindrical collar element 27 having a threaded interior surface 28 whose purpose and function will be described presently.

Figure 2:
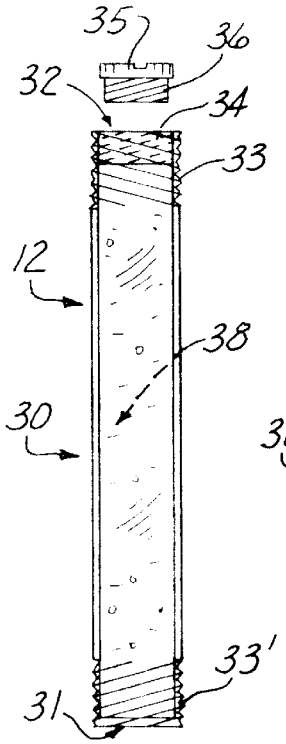
FIG. 2 is an isolated exploded side view of the chiller insert unit.
Figure 3:
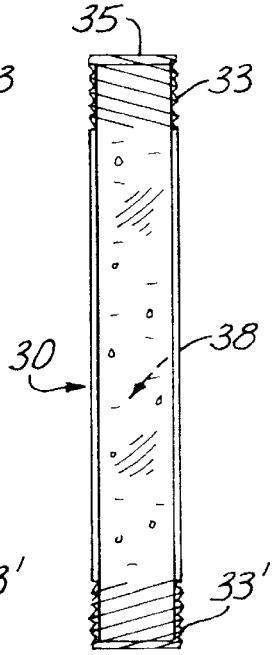
FIG. 3 is a side plan view of the assembled chiller insert unit.

Turning now to FIGS. 2 and 3, it can be seen that the chiller insert unit 12 comprises a generally elongated cylindrical hollow tubular insert member 30 having a closed bottom 31 and an open top 32. Both the upper and lower ends of the tubular member 30 are provided with external threads 33, 33', respectively, and the upper end is further provided with internal threads 34.

As can also be seen by reference to FIGS. 2 and 3, the chiller insert unit 12 also includes a closure member 35 having a threaded stem 36 which is dimensioned to threadedly engage the internal threads 34 in the upper end of the tubular member 30 to form a sealed receptacle for a freezable gel 38 which is employed to chill any liquid beverage that comes into contact with the external surface of the tubular member 30.

Figure 5:
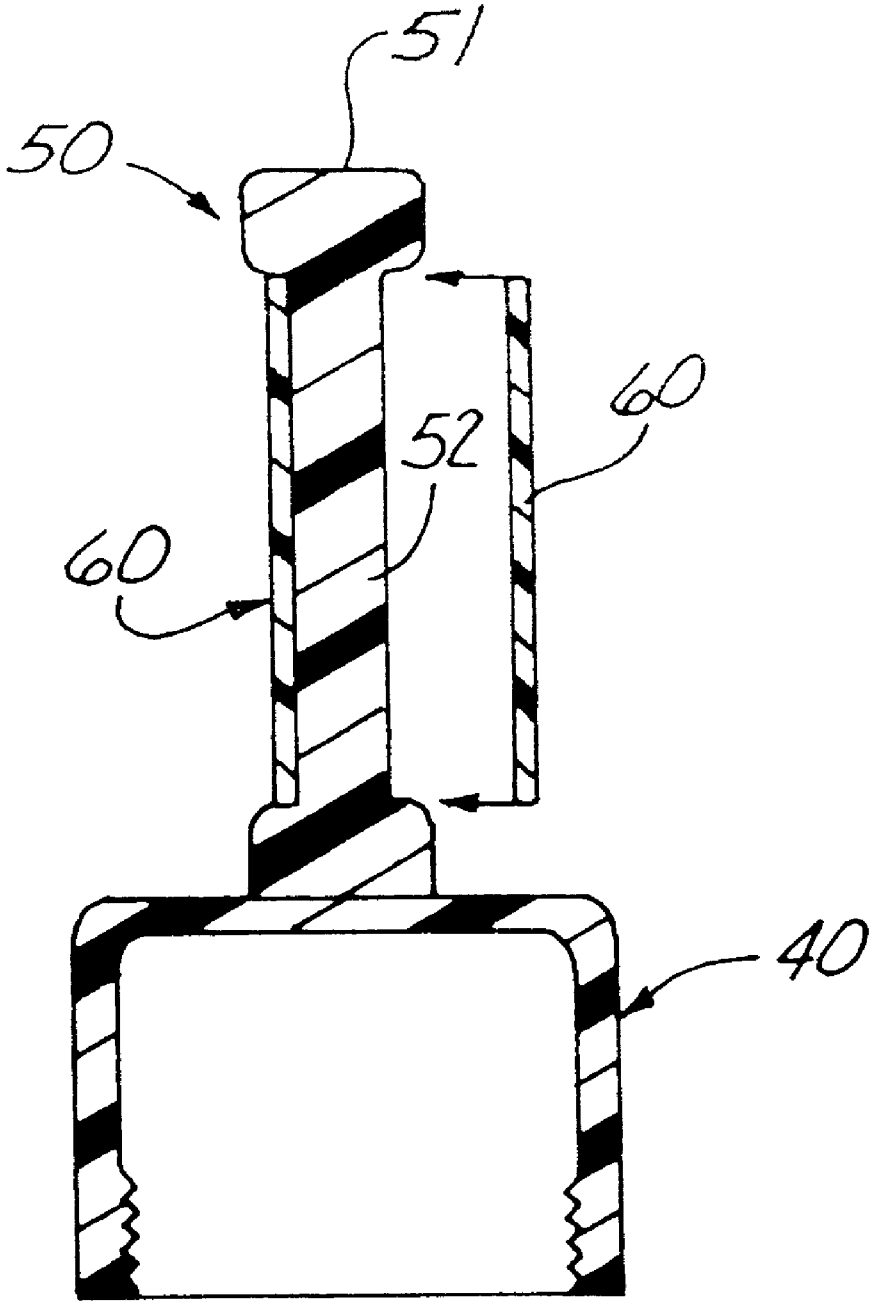
FIG. 5 is a cross sectional view taken through line 5—5 of FIG. 4.

As can best be appreciated by reference to FIGS. 4 and 5, the advertising unit 13 comprises an internally threaded cap member 40 which is dimensioned to engage the external threads 33 on the upper end of the tubular insert member 30.

In addition, the top of the cap member 40 supports an advertising panel member 50 having a closed loop peripheral lip 51 which is fixedly secured to the cap member 40 and surrounds a central partition 52 that will serve as a backing for removable advertising element 60 whose outer edges will be frictionally engaged by the peripheral lip 51 in a well recognized fashion.

At this juncture, it should be appreciated that not only does the cap member 40 threadedly engage the external threads 33 on the upper end of the tubular insert member 30 to provide an additional sealing mechanism over the cap element 35 to retain the freezable gel 38 within the tubular insert member 30, but the advertising panel member 50 also provides a gripping surface for the user to not only thread the cap member 40 over the top of the insert member, but also to threadedly engage and disengage the lower end of the tubular insert member 30 relative to the collar 27 inside the receptacle member.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A chiller arrangement for chilling liquid beverages wherein the arrangement comprises:

a receptacle unit including a pitcher shaped serving receptacle member having side walls extending upwardly from a generally flat receptacle base;

a chiller unit including an elongated hollow tubular insert member having a closed lower end and an open upper end provided with a removable closure element for sealingly engaging said upper end;

means for captively engaging the lower end of the tubular insert member in the receptacle base; and an advertising unit including a cap member adapted to be captively engaged over both the upper end of the tubular insert member and the closure element wherein the cap member has a top surface which is fixedly connected to an advertising panel member; wherein the advertising panel member includes a peripheral lip that is fixedly secured to the cap member.

2. The arrangement as in claim 1 wherein the receptacle base is provided with a centrally disposed cylindrical collar element which is provided with internal threads.

3. The arrangement as in claim 2 wherein the lower end of the tubular insert member is provided with external threads dimensioned to engage the internal threads on the collar element.

4. The arrangement as in claim 1 wherein the upper end of the tubular insert member is provided with both internal and external threads.

5. The arrangement as in claim 4 wherein the cap element is provided with external threads which engage the internal threads on the upper end of the tubular insert member.

6. The arrangement as in claim 4 wherein the cap member is provided with internal threads which engage the external threads on the upper end of the tubular insert member.

7. The arrangement as in claim 5 wherein the cap member is provided with internal threads which engage the external threads on the upper end of the tubular insert member.

8. The arrangement as in claim 1 wherein the advertising panel member further includes at least one advertising element.

9. The arrangement as in claim 8 wherein said at least one advertising element is removably associated with said advertising panel member.

10. The arrangement as in claim 1 wherein said peripheral lip is adapted to receive at least one advertising element.

11. The arrangement as in claim 10 wherein said peripheral lip defines a closed loop.

12. The arrangement as in claim 11 wherein said peripheral lip surrounds a central partition.

13. The arrangement as in claim 12 wherein the opposite sides of said central partition are adapted to be engaged by a pair of advertising elements.

14. The arrangement as in claim 13 wherein the periphery of the pair of advertising elements are also adapted to be engaged by said peripheral lip.

15. A chiller arrangement for chilling liquid beverages wherein the arrangement comprises:

a receptacle unit including a pitcher shaped serving receptacle member having side walls extending upwardly from a generally flat receptacle base;

a chiller unit including an elongated hollow tubular insert member having a closed lower end and an open upper end provided with a removable closure element for sealingly engaging said upper end;

means for captively engaging the lower end of the tubular insert member in the receptacle base; and an advertising unit including a cap member adapted to be captively engaged over both the upper end of the tubular insert member and the closure element wherein the cap member has a top surface which is fixedly connected to an advertising panel member wherein the receptacle base is provided with a centrally disposed cylindrical collar element which is provided with internal threads; and, wherein the lower end of the tubular insert member is provided with external threads dimensioned to engage the internal threads on the collar element.

16. The arrangement as in claim 15 wherein the upper end of the tubular insert member is provided with both internal and external threads.

17. The arrangement as in claim 16 wherein the cap element is provided with external threads which engage the internal threads on the upper end of the tubular insert member.

18. The arrangement as in claim 16 wherein the cap member is provided with internal threads which engage the external threads on the upper end of the tubular insert member.

19. The arrangement as in claim 17 wherein the cap member is provided with internal threads which engage the external threads on the upper end of the tubular insert member.

20. The arrangement as in claim 15 wherein the advertising panel member further includes at least one advertising element.

* * * * *